US010590809B2

(12) United States Patent
Yankovic et al.

(10) Patent No.: US 10,590,809 B2
(45) Date of Patent: Mar. 17, 2020

(54) VALVE TRAIN ASSEMBLY

(71) Applicant: Eaton Corporation, Cleveland, OH (US)

(72) Inventors: Eric John Yankovic, Augusta, MI (US); Majo Cecur, Rivarolo Canavese (IT); Debra Lynn McFadden, Bath, MI (US); Andrei Dan Radulescu, Marshall, MI (US); Anthony Leon Spoor, Marshall, MI (US); Douglas Wright, Nottawa, MI (US)

(73) Assignee: Eaton Corporation, Cleveland, OH (US)

( * ) Notice: Subject to any disclaimer, the term of this patent is extended or adjusted under 35 U.S.C. 154(b) by 196 days.

(21) Appl. No.: 15/799,188

(22) Filed: Oct. 31, 2017

(65) Prior Publication Data

US 2018/0045084 A1 Feb. 15, 2018

Related U.S. Application Data

(63) Continuation of application No. PCT/US2016/031423, filed on May 9, 2016.
(Continued)

(51) Int. Cl.
*F01L 1/26* (2006.01)
*F01L 1/245* (2006.01)
(Continued)

(52) U.S. Cl.
CPC ..... *F01L 1/245* (2013.01); *F01L 1/182* (2013.01); *F01L 1/183* (2013.01); *F01L 1/24* (2013.01);
(Continued)

(58) Field of Classification Search
CPC . F01L 1/245; F01L 1/182; F01L 1/183; F01L 1/24; F01L 1/2405; F01L 13/0005;
(Continued)

(56) References Cited

U.S. PATENT DOCUMENTS 4,840,151 A 6/1989 Sakata
7,032,564 B1 4/2006 Kryglowski et al.
(Continued)

FOREIGN PATENT DOCUMENTS

WO 0020730 A1 4/2000

OTHER PUBLICATIONS

International Search Report and Written Opinion for International Application No. PCT/US2016/031423 dated Aug. 16, 2016, 15 pages.

*Primary Examiner* — Zelalem Eshete
(74) *Attorney, Agent, or Firm* — RMCK Law Group PLC

(57) ABSTRACT

A valve train assembly having a valve train carrier including a body having a cartridge cavity formed in the body, a hydraulic lash adjuster adjustment (HLA) assembly, and a cartridge removably disposed in the cartridge cavity. The cartridge includes a main body defining an inner bore, wherein the HLA assembly is disposed in the inner bore, and the cartridge is sized and shaped for insertion into the cartridge cavity formed in an underside of the valve train carrier. The cartridge is configured to have a valve train lash set prior to insertion into the cartridge cavity. A rocker arm assembly includes a body configured to engage the hydraulic lash adjustment (HLA) assembly, an end having a socket formed therein, and an e-foot extending through the socket and coupled to the end, the e-foot configured to maintain substantially flat contact with a top surface of an engine valve.

30 Claims, 7 Drawing Sheets

Related U.S. Application Data

(60) Provisional application No. 62/158,528, filed on May 7, 2015.

(51) Int. Cl.

| | |
|---|---|
| ***F01L 1/18*** | (2006.01) |
| ***F01L 13/00*** | (2006.01) |
| ***F01L 1/24*** | (2006.01) |
| *F01L 1/053* | (2006.01) |

(52) U.S. Cl.
CPC ..... *F01L 1/2405* (2013.01); *F01L 13/0005* (2013.01); *F01L 2001/0535* (2013.01); *F01L 2001/188* (2013.01); *F01L 2013/001* (2013.01); *F01L 2101/00* (2013.01); *F01L 2105/00* (2013.01); *F01L 2810/02* (2013.01)

(58) Field of Classification Search
CPC ..... F01L 13/001; F01L 2001/0535; F01L 2001/188; F01L 2101/00; F01L 2105/00; F01L 2810/02
See application file for complete search history.

(56) References Cited

U.S. PATENT DOCUMENTS

| | | | | |
|---|---|---|---|---|
| 7,568,459 | B2 | 8/2009 | Best | |
| 7,707,979 | B2 | 5/2010 | Best | |
| 2012/0174885 | A1 | 7/2012 | Riley | |
| 2012/0210964 | A1* | 8/2012 | Barnes ..... | F01L 1/053 123/90.39 |
| 2014/0202406 | A1 | 7/2014 | Nakamura | |

* cited by examiner

VALVE TRAIN ASSEMBLY

CROSS-REFERENCE TO RELATED APPLICATIONS

This application is a continuation of International Application No. PCT/US2016/031423 filed May 9, 2016, which claims the benefit of U.S. Patent Application No. 62/158,528, filed on May 7, 2015, the contents of which are incorporated herein by reference.

FIELD

The present disclosure relates generally to a valve train assembly for an internal combustion engine and, more particularly, to a valve train assembly having stiffness increasing components and valve motion deactivation.

BACKGROUND

Internal combustion engines having a plurality of valves for each cylinder typically use rocker arms mounted on a common pivot or axle. The rocker arms may include a hydraulic lash adjustment (HLA) assembly mounted near a valve tip of the rocker arm, to take up slack in the valvetrain. The HLA assembly typically includes an oil-containing chamber defined between an outer body and a plunger assembly slidably mounted within the outer body. A spring is arranged to enlarge the chamber by pushing the plunger assembly outwardly from the outer body to extend the HLA. Oil flows into the chamber via a one way valve, but can escape the chamber slowly, for example, via closely spaced leak down surfaces. The HLA can extend to accommodate any slack in the valve train assembly, for example, between a cam and a roller of the rocker arm.

The background description provided herein is for the purpose of generally presenting the context of the disclosure. Work of the presently named inventors, to the extent it is described in this background section, as well as aspects of the description that may not otherwise qualify as prior art at the time of filing, are neither expressly nor impliedly admitted as prior art against the present disclosure.

SUMMARY

In one aspect, a valve train carrier for a valve train assembly is provided. The valve train carrier includes a body having a top surface and a bottom surface, a left bank configured to operably connect to at least one exhaust rocker arm assembly associated with an exhaust valve, a right bank configured to operably connect to at least one intake rocker arm assembly associated with an intake valve, and a cartridge cavity configured to receive a modular cartridge that houses a hydraulic lash adjustment (HLA) assembly.

In addition to the foregoing, the described system may include one or more of the following features: wherein the cartridge cavity is formed in the body bottom surface such that the modular cartridge is inserted into the cavity from below the body; two oil control valve apertures formed in the body configured to each receive an oil control valve; wherein the left bank is configured to operably connect to four exhaust rocker arm assemblies; wherein the right bank is configured to operably connect to four intake rocker arm assemblies; wherein the left bank is configured to operably connect to two standard position exhaust rocker arm assemblies and two cylinder deactivation (CDA) position exhaust rocker arm assemblies; wherein the right bank is configured to operably connect to two standard position intake rocker arm assemblies and two CDA position intake rocker arm assemblies; and wherein the body is fabricated from aluminum.

In another aspect, a rocker arm assembly for a valve train assembly is provided. The rocker arm assembly includes a body configured to engage a hydraulic lash adjustment (HLA) assembly, a first end having a roller, a second end having a socket formed therein, and an e-foot extending through the socket and coupled to the second end, the e-foot configured to maintain substantially flat contact with a top surface of an engine valve.

In addition to the foregoing, the described system may include one or more of the following features: wherein the socket includes a hemispherical contact surface; wherein the e-foot includes a hemispherical body and a post extending therefrom, the hemispherical body configured to ride the hemispherical contact surface; wherein the post extends through a slot the socket, the slot configured to guide and restrain movement of the a-foot, wherein the post is coupled to the body by staking the post; wherein the post is retained to the body by a clip; wherein the body includes a pair of lateral flanges connected by a connecting plate, the socket being formed in the connecting plate; wherein the body further includes a bridge coupled between the lateral flanges opposite the connecting plate; a recess formed in the connecting plate configured to mate with a spigot of the HLA assembly, the recess and spigot forming a fulcrum about which the rocker arm assembly can rotate; wherein the lateral flanges each include an aperture to receive an axle of the roller.

In yet another aspect, a cartridge for a valve train carrier of a valve train assembly is provided. The cartridge includes a main body defining an inner bore configured to receive and house a hydraulic lash adjustment (HLA) assembly. The cartridge is sized and shaped for removable insertion into a cartridge cavity formed in an underside of the valve train carrier, the cartridge configured to have a valve train lash set prior to insertion into the cartridge cavity.

In addition to the foregoing, the described system may include one or more of the following features: wherein the cartridge is fabricated from iron or steel; wherein the cartridge is fabricated from cast iron and graphite; an upper flange extending upwardly from the main body, the upper flange partially defining the inner bore; a lower flange extending downwardly from the main body, the lower flange partially defining the inner bore; a fluid port configured to receive a hydraulic fluid from the valve train carrier and supply the hydraulic fluid to the HLA assembly; a first latch flange extending outwardly from the main body, the first latch flange defining a first latch bore having a first latch assembly configured to selectively engage the HLA assembly; a second latch flange extending outwardly from the main body, the second latch flange defining a second latch bore having a second latch assembly configured to selectively engage the HLA assembly; wherein the first latch assembly is disposed opposite the second latch assembly; wherein the first latch assembly and the second latch assembly are disposed 180° apart; and wherein the first and second latch flanges define an upper surface configured to contact the valve train carrier and distribute loads in the valve train assembly.

In addition to the foregoing, the described system may include one or more of the following features: wherein the first latch assembly is selectively movable between a first position and a second position by selectively supplying a hydraulic fluid to the first latch assembly; wherein the first latch assembly is selectively movable between a first position and a second position by a solenoid; wherein the first latch assembly includes a first latch pin and a first pin biasing mechanism configured to bias the first latch pin into engagement with the HLA assembly to prevent relative movement between the cartridge and the HLA assembly; wherein the second latch assembly includes a second latch pin and a second latch pin biasing mechanism configured to bias the second latch pin into engagement with the HLA assembly to further prevent relative movement between the cartridge and the HLA assembly; and wherein the latch flange further includes a latch pin orientation feature configured to maintain alignment of a latch pin shelf when the latch assembly is in a retracted position.

In yet another aspect, a valve train assembly is provided. The valve train assembly includes a valve train carrier including a body having a top surface and a bottom surface, a left bank configured to operably connect to at least one exhaust rocker arm assembly associated with an exhaust valve, a right bank configured to operably connect to at least one intake rocker arm assembly associated with an intake valve, and a cartridge cavity formed in the body. The valve train assembly further includes a hydraulic lash adjuster adjustment (HLA) assembly, and a cartridge removably disposed in the cartridge cavity. The cartridge includes a main body defining an inner bore, wherein the HLA assembly is disposed in the inner bore, and the cartridge is sized and shaped for insertion into the cartridge cavity formed in an underside of the valve train carrier. The cartridge is configured to have a valve train lash set prior to insertion into the cartridge cavity. The valve train assembly further includes a rocker arm assembly operably associated with the HLA assembly. The rocker arm assembly includes a body configured to engage the hydraulic lash adjustment (HLA) assembly, a first end having a roller, a second end having a socket formed therein, and an e-foot extending through the socket and coupled to the second end, the e-foot configured to maintain substantially flat contact with a top surface of an engine valve.

BRIEF DESCRIPTION OF THE DRAWINGS

The present disclosure will become more fully understood from the detailed description and the accompanying drawings, wherein.

DETAILED DESCRIPTION

Figure 1:
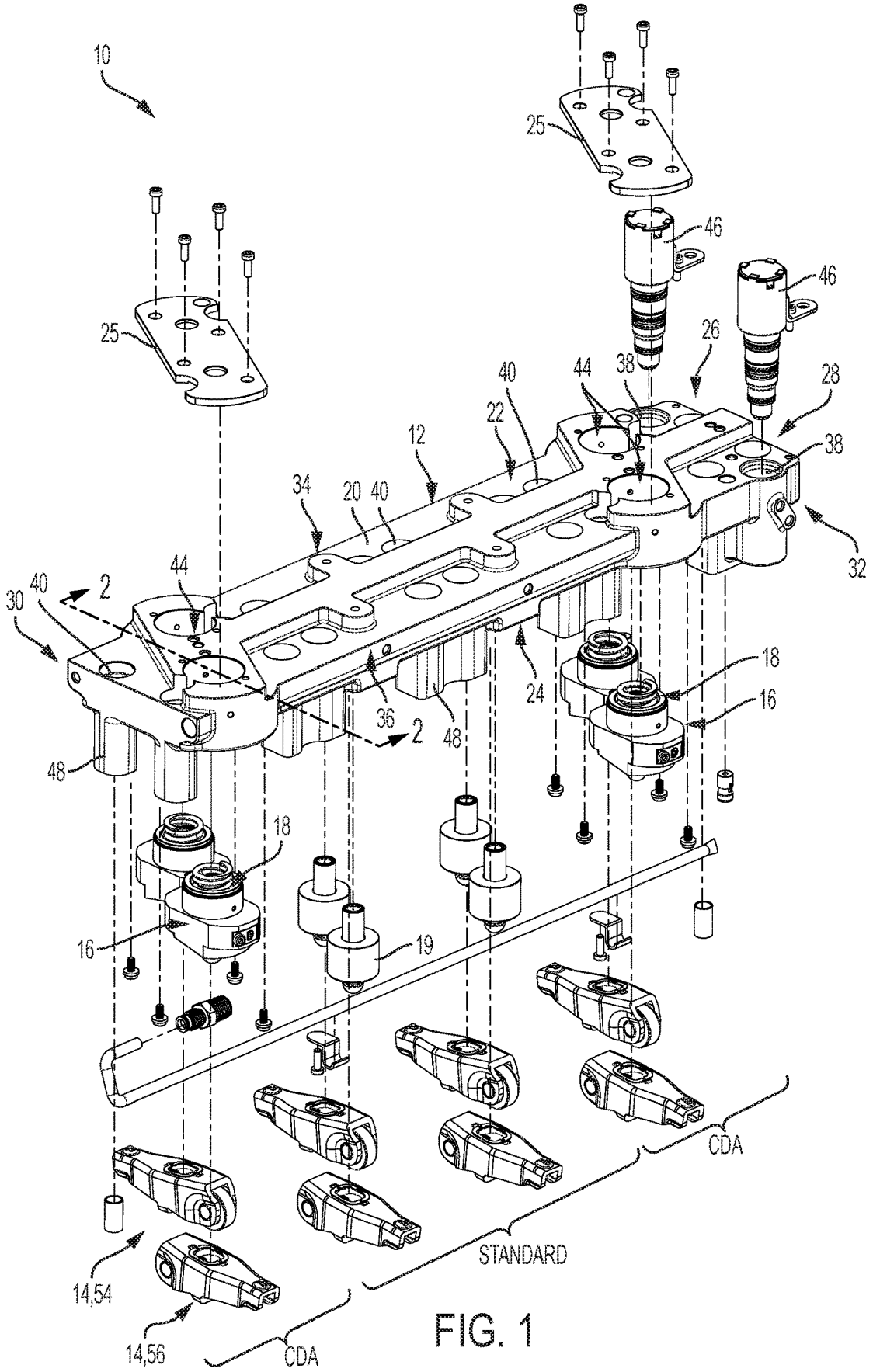
FIG. 1 is an exploded view of a valve train assembly constructed in accordance to one example of the present disclosure.
Figure 2:
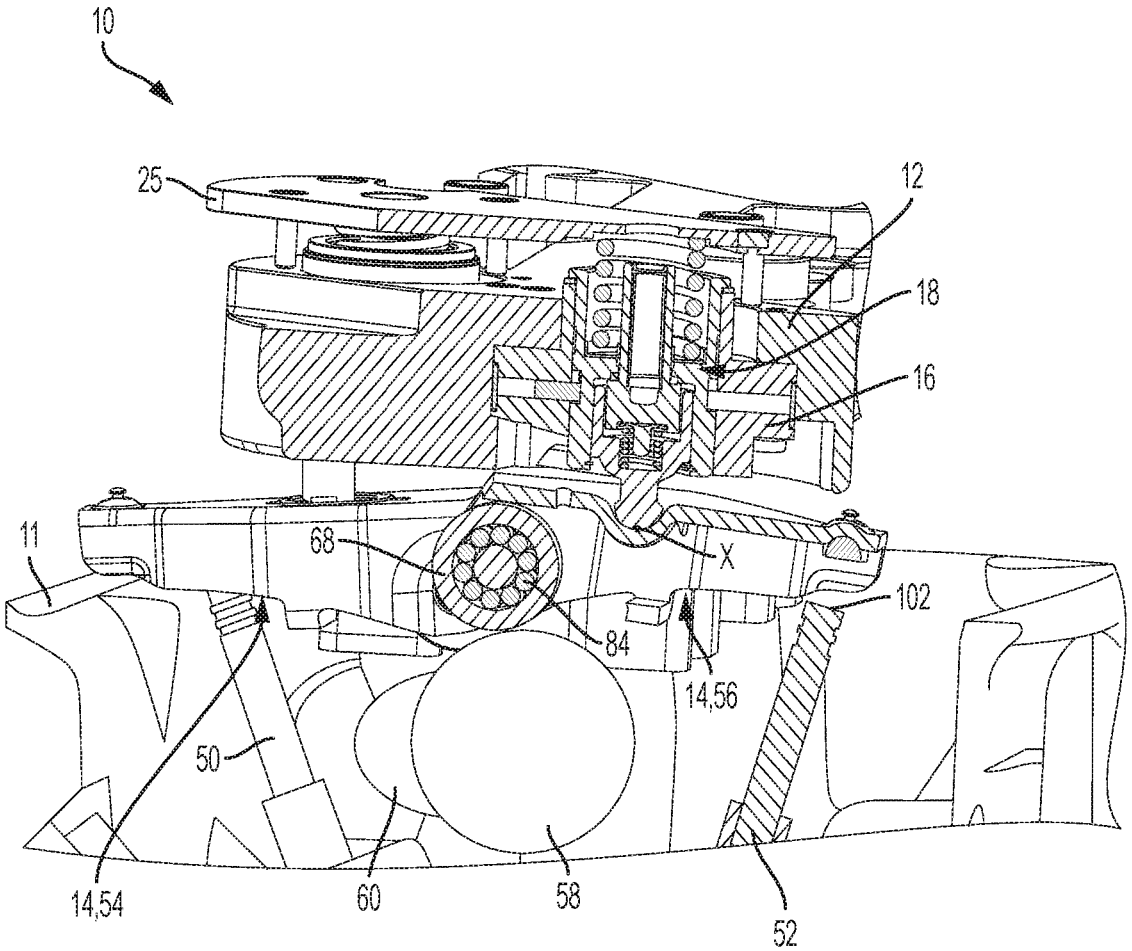
FIG. 2 is a cross-sectional view of the assembly shown in FIG. 1 and taken along line 2-2.

With initial reference to FIGS. 1 and 2, a valve train assembly constructed in accordance with one example of the present disclosure is shown and generally identified at reference 10. In the illustrated example, valve train assembly 10 is shown configured for use in an eight-cylinder engine. It will be appreciated however that the present teachings are not so limited. In this regard, the present disclosure may be used in any suitable valve train assembly. The valve train assembly 10 can generally include a valve train carrier 12, a plurality of rocker arm assemblies 14, a plurality of modular cartridges 16, and a plurality of deactivating hydraulic lash adjuster (HLA) assemblies 18.

In the example implementation, valve train carrier 12 can generally include a body 20 having a top surface 22, a bottom surface 24. Common left and right banks 26, 28 can extend from a first end 30 to an opposite second end 32, and from a first side 34 to an opposite second side 36. The left and right common banks 26, 28 are formed (e.g., cast) from a suitable material (e.g., aluminum) and define OCV apertures 38, fastener apertures 40, and cartridge cavities 44.

The OCV apertures 38 are configured to receive oil control valves (OCV) 46 therein, which are configured to supply oil throughout an oil circuit (not shown) defined within the valve train carrier body 20. The oil circuit can include both a low pressure HLA feed gallery to supply the deactivating HLA assemblies 18, and a high pressure switching gallery that can supply pressurized fluid to components such as latch assemblies described herein. As such, OCVs 46 may supply oil to rocker arm assemblies 14, cartridges 16, and/or deactivating HLA assemblies 18. As illustrated, valve train carrier 12 includes two OCVs 46 located at second end 32. However, the valve train carrier 12 may have any number of OCVs positioned in any suitable location on the carrier body 20.

Each fastener aperture 40 is associated with a leg 48 that extends downwardly from the bottom surface 24 of the valve train carrier body 20. As such, a fastener (not shown) can be inserted into each fastener aperture 40 from the top surface 22 to thereby couple the valve train carrier 12 to a cylinder head 11 (FIG. 2).

The cartridge cavities 44 are formed in the underside 24 of the carrier body 20 and are sized and shaped to each receive one modular cartridge 16 with a deactivating HLA assembly 18. A plate 25 is coupled to carrier top surface 22 to facilitate retaining cartridges 16 and HLAs 18 within cavities 44. As illustrated, left and right banks 26, 28 each include two cartridges 16 with deactivating HLA assemblies 18. As such, the modular cartridge 16 can be easily removed and replaced from cartridge cavity 44 when required. However, valve train carrier 12 may include any number of cavities 44 to receive a cartridge 16 and HLA assembly 18. For example, the valve train carrier 12 can have eight cavities 44 such that all eight rocker arm positions are deactivating.

In the illustrated example, valve train carrier 12 is an overhead carrier design that is typically installed over top of the camshaft and is configured to support the rocker arm assemblies 14 in a staggered configuration such that the rocker arm assemblies 14 alternate between driving an intake valve 50 and an exhaust valve 52 (see FIG. 2). In this way, valve train carrier 12 supports two rocker arm assemblies 14 per cylinder of the engine. However, valve train carrier 12 is not limited to an overhead design, and carrier 12 may have any suitable design that enables valve train assembly 10 to function as described herein.

As shown, valve train carrier 12 includes eight individual rocker arm assemblies 14. In the illustrated example, the four interior rocker arm assemblies 14 are standard position assemblies, and the four outer rocker arm assemblies 14 are cylinder deactivation (CDA) position assemblies. The standard position assemblies are in non-switching positions such that an HLA 19 (FIG. 1) just compensates for lash in the position. The CDA position assemblies are configured to switch between a lift mode where the assembly acts like the standard position assembly, and a CDA mode where the valve is deactivated and cam motion is transferred to the rocker arm, but the motion is absorbed and not translated to the valve. However, the valve train carrier 12 may have other configurations such as, for example, with the four outer rocker arm assemblies 14 being standard position assemblies and the four interior rocker arm assemblies 14 being CDA position assemblies.

Each cylinder of the engine includes an intake valve rocker arm assembly 54 and an exhaust valve rocker arm assembly 56. The intake valve rocker arm assembly 54 is configured to control motion of one intake valve 50, and the exhaust valve rocker arm assembly 56 is configured to control motion of an exhaust valve 52. A cam shaft 58 (FIGS. 2 and 5) includes lift profiles or cam lobes 60 configured to rotate rocker arm assemblies 14 to activate the associated intake valve 50 or exhaust valve 52.

In the example implementation shown in FIG. 2, each rocker arm assembly 14 is a center-pivoted rocker arm and is mounted on one deactivating hydraulic lash adjuster (HLA) assemblies 18 positioned between a first end 64 and a valve tip or second end 66 of the rocker arm assembly 14. The first end 64 includes a roller 68 configured to be displaced by the cam lobe 60, and the second end 66 includes an e-foot 70 configured to transmit motion from the cam lobe 60 to open the valve 50 or 52.

Figure 3:
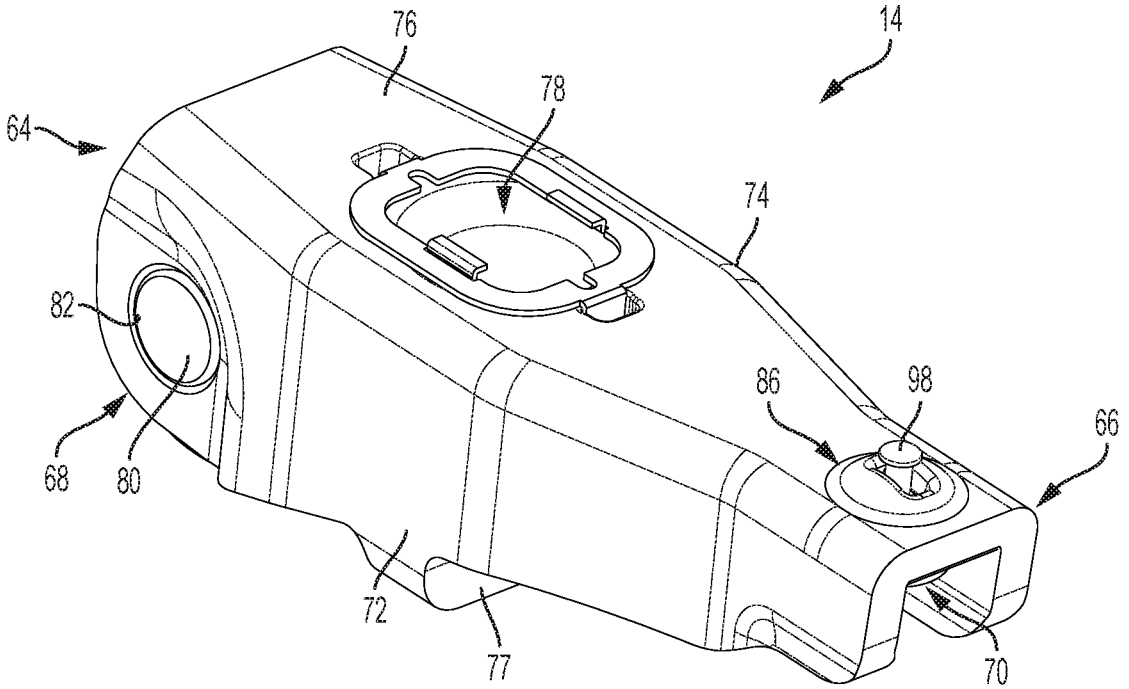
FIG. 3 is a perspective view of an example rocker arm assembly that may be used with the valve train assembly shown in FIG. 1.
Figure 4:
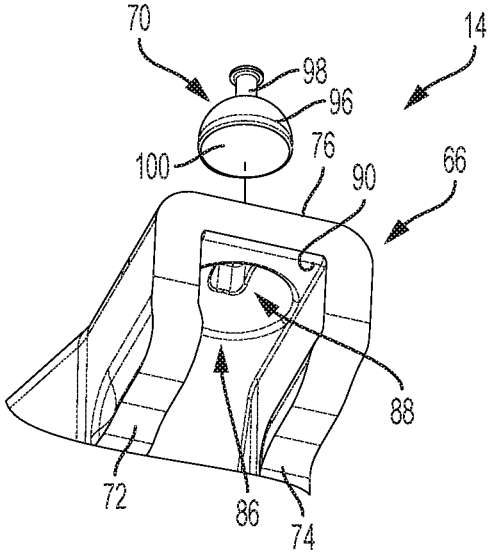
FIG. 4 is a bottom perspective view of a portion of the rocker arm assembly shown in FIG. 3.

With reference to FIGS. 3 and 4, each rocker arm assembly 14 generally includes opposed lateral flanges 72 and 74 connected by a connecting plate 76. A bridge 77 (FIG. 3) may be coupled between lateral flanges 72, 74 opposite plate 76 to increase stiffness of the rocker arm assembly 14. In one example implementation, rocker arm assembly 14 is formed by stamping. Connecting plate 76 is formed with a recess 78 suitable for mating with a spigot 158 of the HLA assembly 18. Cooperation between spherical surfaces of the recess 78 and the spigot 158 form a fulcrum about which the rocker arm 14 can reciprocate in order to operate the valve 50, 52. As such, the rocker arm 14 can rotate about an axis 'X' (FIG. 2).

The rocker arm first end 64 supports roller 68 through a roller axle 80 extending through apertures 82 formed in lateral flanges 72, 74. Roller 68 further includes bearings 84 (e.g., roller, needle). Accordingly, roller 68 is rotatable about axle 80 and is configured to impart motion from the cam lobe 60 to the engine valve 50, 52.

The rocker arm second end 66 includes a socket 86 formed in the connecting plate 76, as shown in FIG. 4. The socket 86 includes a hemispherical contact surface 88 formed in a bottom surface 90 of the connecting plate 76, and a slot 92 extending through the connecting plate 76 between the hemispherical contact surface 88 and a top surface 94 of the connecting plate 76.

The e-foot 70 includes a hemispherical body 96 and a post 98 extending therefrom. The hemispherical body 96 is configured to cooperate with or ride the hemispherical contact surface 88 such that e-foot 70 can rotate to maintain a flat surface 100 in a flat or parallel contact with a top surface 102 of the valve 50, 52. As such, the hemispherical body 96 can move along or follow the contact surface 88 to create as much contact stress area as possible.

In the example implementation, the post 98 extends into the slot 92, which is configured to restrain the rotational freedom and movement of the e-foot 70, thereby controlling movement of the e-foot 70. In the example implementation, the e-foot 70 can be movably coupled to the rocker arm 14 by using a clip (not shown) on post 98 or displacing portions (e.g., staking) of the post 98 once it has been inserted through the slot 92. In this way, the e-foot 70 can swivel with respect to the rocker arm 14 and is configured to control wobble of the valve 50, 52 by rotating such that the bottom surface 100 will remain flush or substantially flush with the valve 50, 52. This can ensure even loading of the valve tip 66 by accepting minor system angular variation, thereby reducing valve tip stress and minimizing valve tip wear.

Figure 5:
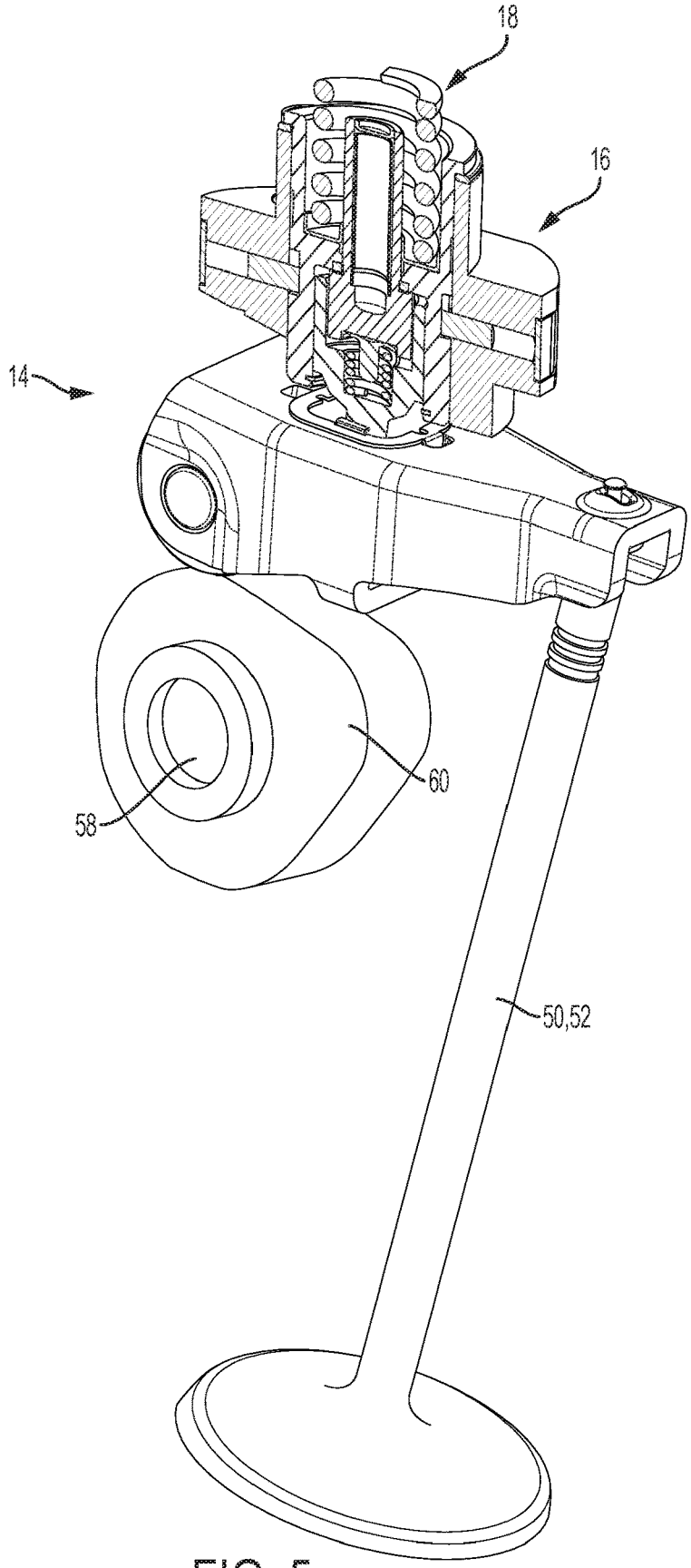
FIG. 5 is a partial sectional view of a portion of the valve train assembly shown in FIG. 1.
Figure 6:
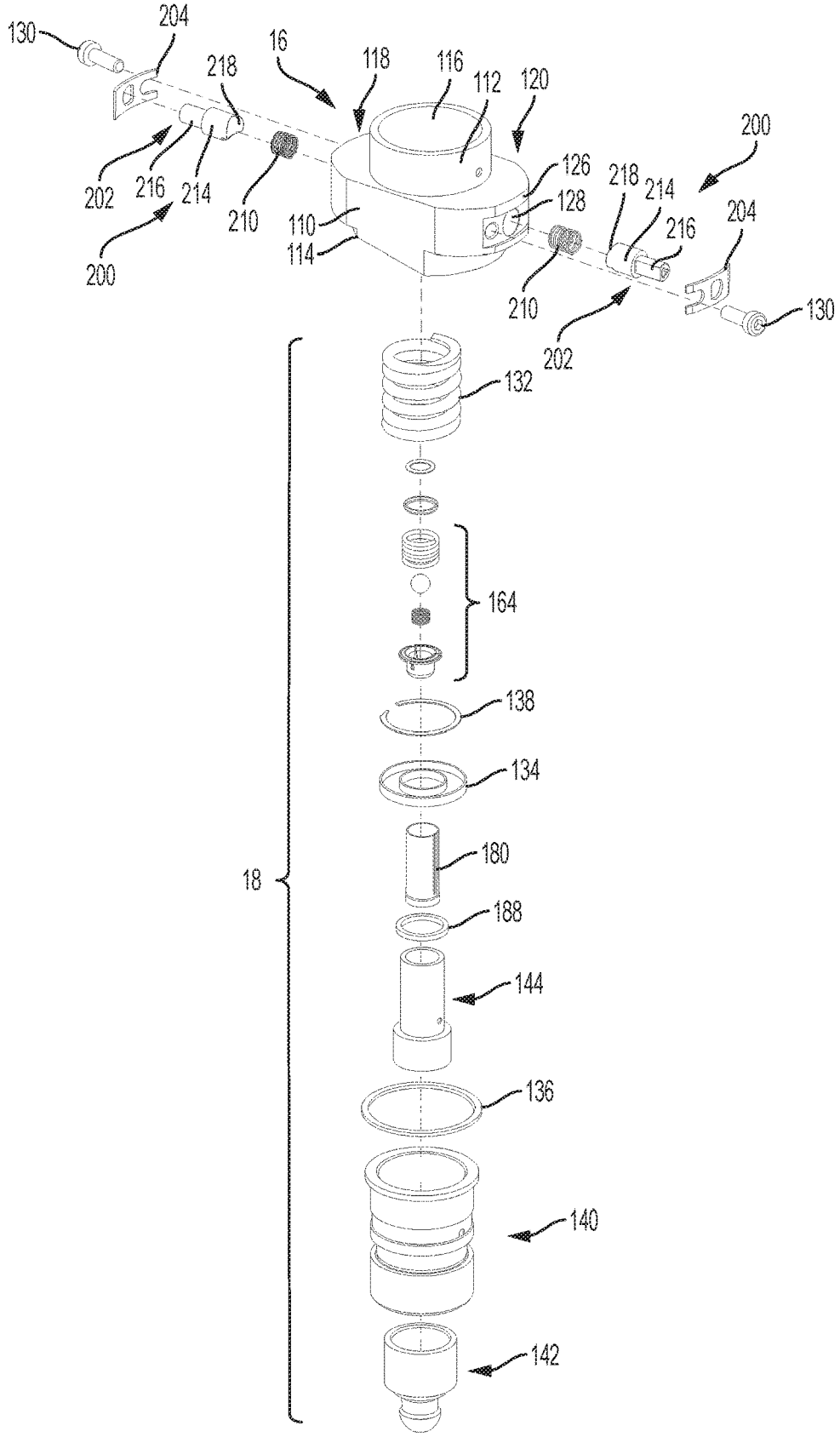
FIG. 6 is an exploded view of an example modular cartridge and deactivating hydraulic lash adjustment (HLA) assembly that may be used with the valve train assembly shown in FIG. 1.
Figure 7:
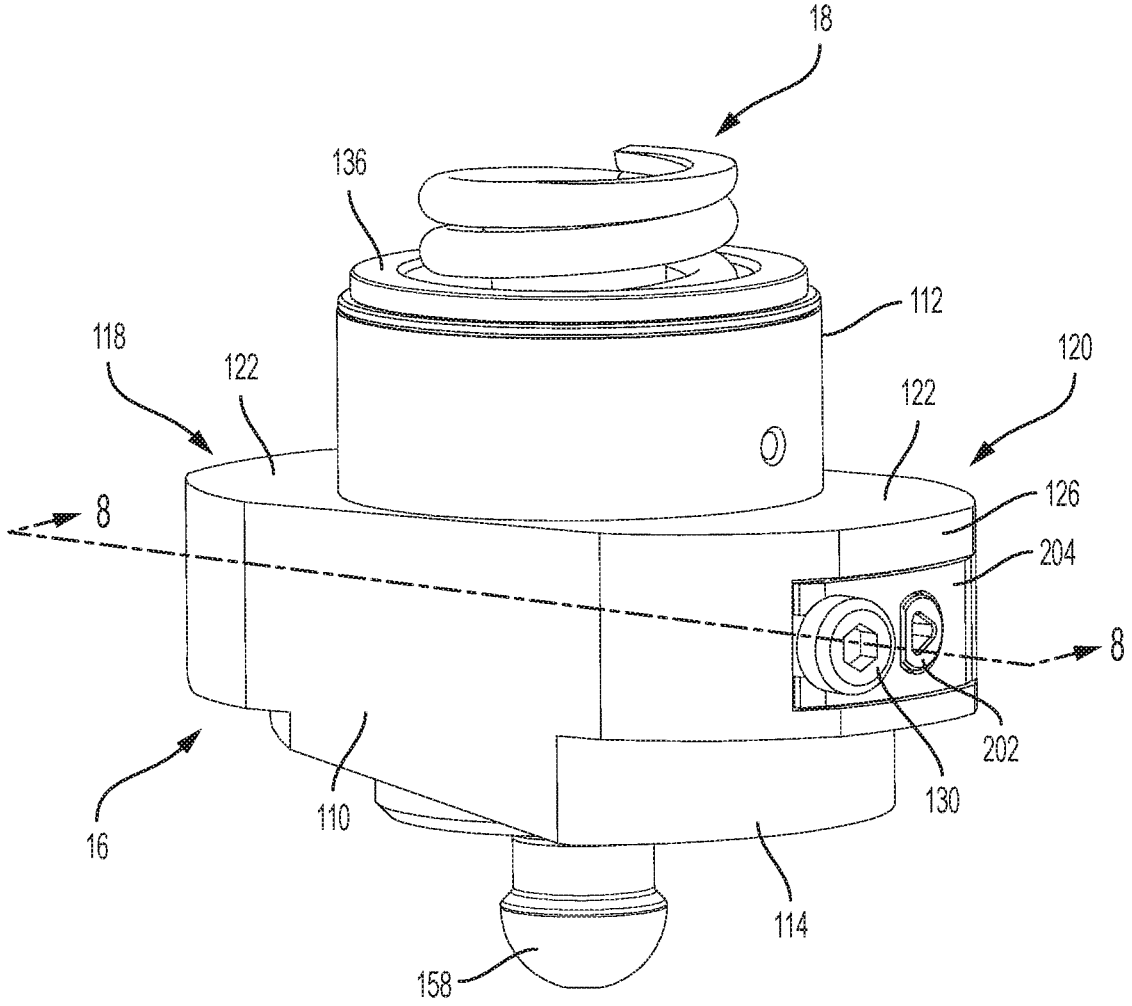
FIG. 7 is a perspective view of the modular cartridge and HLA assembly shown in FIG. 6.
Figure 8:
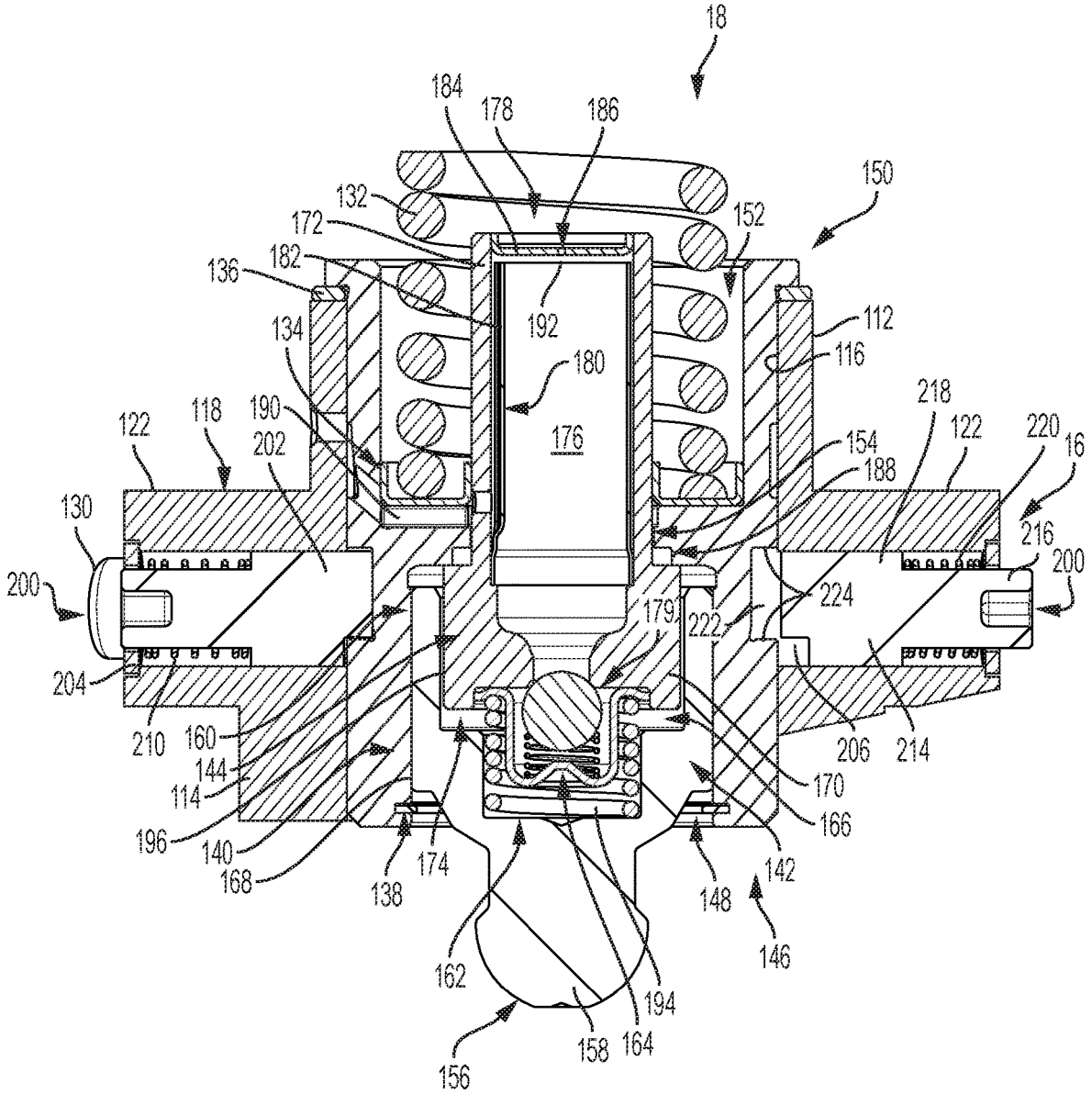
FIG. 8 is a cross-sectional view of the modular cartridge and HLA assembly shown in FIG. 7 and taken along line 8-8.

As shown in FIGS. 2 and 5, the deactivating HLA assembly 18 is housed within the modular cartridge 16 and maintains one end 64 of the rocker arm 14 pressed against the cam 60 through the roller 68, and the other end 66 pressed against valve 50, 52. With further reference to FIGS. 6-8, the modular cartridge 16 and deactivating HLA assembly 18 will be described in more detail.

The modular cartridge 16 is configured to support HLA assembly 18, and is sized and shaped to be received in one of cavities 44 formed in the underside 24 of the valve train carrier body 20. In the example implementation, the modular cartridge 16 is fabricated from a hard material such as iron or steel, which provides benefits in wear and friction reduction. In other examples, the modular cartridge 16 may be fabricated from cast iron with graphite for providing increased lubrication. As such, cartridge 16 provides improved stiffness and wear than if it were made with a softer material.

As shown in FIG. 7, modular cartridge 16 generally includes a main body portion 110, an upper flange 112, and a lower flange 114 that collectively define an inner cavity or bore 116 configured to at least partially receive the deactivating HLA assembly 18. The main body portion 110 includes opposed first and second latch flanges 118 and 120 that define upper contact surfaces 122, which are configured to dissipate the load of the valve train assembly 10 over a greater area and move the load closer to the bolts connecting the valve train carrier 12 to the cylinder head 11 (FIG. 2). Accordingly, load deflection is reduced and the load can be transferred to the support bolts on a more direct path, which increases system stiffness.

As shown in FIG. 8, the first and second latch flanges 118, 120 are each configured to receive a latch assembly 200 within a bore 124 defined therein. Flanges 118, 120 include an end surface 126 with an aperture 128 formed therethrough configured to receive the latch assembly 200. In this way, the latch assembly 200 can be inserted through aperture 128 and located within the bore 124 before the modular cartridge 16 is inserted into the valve train carrier 12. This enables both sides of the cartridge 16 to be utilized, which allows the use of two latch assemblies 200 for HLA assembly 18, thereby providing increased stiffness and load distribution compared to a single latch system. In the example embodiment, latch assemblies 200 are located 180° or approximately 180° from each other on the cartridge 16. Moreover, the latch flanges of cartridge 16 support the latch assemblies 200 and any load passing therethrough, thereby providing increased stiffness to the deactivating HLA assembly 18 and valve train assembly 10. Additionally, latch flange end surface 126 can include a retention bolt 130 configured to at least partially secure latch assembly 200.

As illustrated, modular cartridge 16 is configured to support deactivating HLA assembly 18 including the dual latch assemblies 200, which can be inserted into the modular cartridge 16 prior to the cartridge being inserted into the underside of the valve train carrier 12. This allows any valve train lash to be set while the modular cartridge 16 and HLA assembly 18 are outside of the carrier. Additionally, sensitive adjustments for lash and latch pin rotation can be set in each individual modular cartridge 16 independent of the carrier 12. In one implementation, latch pin rotation is set and checked by inserting the latch into bore 124, rotating a latch pin 202 clockwise and counterclockwise until the patch pin 202 contacts an inner body shelf, and then measuring the rotation. The latch pin 202 is then rotated to an even angle between the clockwise and counterclockwise measured rotations and held in position, and an orientation and retention strap 204 is adjusted to a flat surface or shelf 206 on the latch pin 202. The strap 204 can then be fastened to the cartridge 16, for example, via welding or bounding (e.g., by retention bolt 130).

As such, each modular cartridge 16 may be verified for precision and function before being subsequently assembled into the carrier 12. The modular design of modular cartridge 16 enables quick and easy replacement of faulty cartridges in cavity 44, and storage space and part handling during the rework loop is reduced and simplified. Moreover, the modular cartridge 16 does not require any retention features, as the cartridge can be held in place within cavity 44 by valve train loads such as the camshaft 58, the valves 50, 52, and the valve spring (not shown) exerting upward force onto the rocker arm 14.

With continued reference to FIGS. 6 and 8, deactivating HLA assembly 18 is configured to engage rocker arm 14 and take up any lash between the HLA assembly 18 and the rocker arm assembly 14. Moreover, HLA assembly 18 is configured to move between an activated position where the HLA assembly 18 presses against the rocker arm 14 to transfer motion from the cam lobe 60 to the engine valve 50, 52, and a deactivated position where the HLA assembly 18 absorbs motion from the cam lobe 60 such that rocker arm 14 does not engage the valve 50, 52.

The HLA assembly 18 can be moved between the activated and deactivated positions, for example, through the latch assemblies 200 that are selectively actuated by a flow of fluid (e.g., hydraulic oil). However, in other implementations, latch assemblies 200 may be moved between the activated and deactivated positions by an electro-mechanical device (not shown) such as a solenoid mounted directly to the carrier 12 with an electrical connection to power the latch assemblies 200. In this way, cartridge 16 supports stationary latch assemblies that can allow for future electric latching.

The deactivating HLA assembly 18 can generally include an outer body 140, a plunger 142, and an inner body 144.

The outer body 140 is received by the bore 116 formed in the modular cartridge 16 and can have a first open end 146 defining a lower first chamber 148, an open second end 150 defining an upper second chamber 152, and a passage 154 extending between the lower chamber 148 and the upper chamber 152. A lost motion biasing mechanism 132 (e.g., a spring) is seated within the upper chamber 152 in a spring seat and oil seal 134. In one implementation, the inner body 144 is press fit within or otherwise coupled to or retained by the seat and seal 134. The biasing mechanism 132 is configured to bias the outer body 140 downward to expand the plunger 142 and take up any lash. A spacer 136 may be utilized to provide spacing or an initial lash for outer body 140. In one implementation, the lower chamber 148 has a diameter of 21 mm or approximately 21 mm in order to reduce oil pressure in the system.

The plunger 142 is received within the outer body lower chamber 148 and can have a closed first end 156 defining the spigot 158, which is received by the recess 78 formed in rocker arm 14, and an open second end 160 that defines a valve seat 162 configured to receive a check ball assembly 164. As described here in more detail, the plunger 142 is hollowed and defines an inner area 166, which provides a considerable mass savings over known designs. The hollowed inner area 166 is configured to partially contain the inner body 144 and the check ball assembly 164, which provides a more compact design and improved oil reserve capabilities, as describe herein in more detail.

A leakdown channel or surface 168 is defined between the plunger 142 and the outer body 140. The leakdown surface 168 is configured to receive a flow of oil from within the plunger 142 that can be utilized to lubricate portions of the rocker arm 14 such as recess 78 and socket 86. In one implementation, the leakdown surfaces 168 are hard turned rather than ground to size, which eliminates the need for a grind relief undercut and reduces the total volume of a high pressure chamber. A retention clip 138 may be utilized to retain plunger 142 within outer body 140.

The inner body 144 can generally include a lower end 170 and an upper end 172. The lower end 170 can have a width or diameter greater than upper end 172 and can be positioned in the outer body lower chamber 148 at least partially within the plunger inner area 166, which optimizes vertical packaging and uses the space within area 166 to create more volume for a low pressure chamber oil reserve 176. In this way, a high pressure oil chamber 174 is defined between the inner body 144 and the inner surface of the plunger 142, with the outer body 140 defining the upper boundary of the high pressure chamber volume. The upper end 172 can extend through the outer body passage 154 into the outer body upper chamber 152.

The inner body 144 includes the low pressure chamber 176 formed therein having an inlet end 178 and an outlet end 179. A sleeve 180 is disposed within the low pressure chamber 176 and defines an oil channel 182 between the sleeve 180 and the inner body 144. A low pressure chamber cap 184 is coupled to the low pressure chamber inlet end 178 and includes an air bleed hole 186 formed therein configured to vent any air trapped in the low pressure chamber 176. A seal 188 may be disposed between the outer body 140 and the inner body 144, which allows the inner body 144 and the outer body 140 to maintain a sliding or slip fit and to ease manufacturing assembly.

Accordingly, the deactivating HLA assembly includes an outer body 140 housing both the plunger 142 and the inner body 144. The outer body 140 includes an oil feed port 190, which is at least partially defined and sealed by the spring seat and seal 134. Oil feed port 190 is configured to receive hydraulic oil or other fluid from carrier 12 or other hydraulic fluid source, and this oil travels through the oil port 190 into the oil channel 182, which is sealed at the top by cap 184. The oil then flows into an inlet port 192 of the sleeve 180 and into the low pressure chamber 176. In the example implementation, the inlet port 192 is sized larger than air bleed hole 186 such that oil flows into the low pressure chamber 176 rather than out of hole 186.

Downward pressure of the oil supply into the low pressure chamber 176 can then cause opening of the check ball assembly 164 and passage into the high pressure chamber 174. The check ball assembly 164 is the only connection between the high pressure chamber 174 and the low pressure chamber 176, and is configured to hold oil within the high pressure chamber 174 between the plunger 142 and the inner body 144. Moreover, check ball assembly 164 prevents oil in the high pressure chamber 174 from returning to the low pressure chamber 176.

The low pressure chamber 176 can act as a low pressure oil reserve for the HLA assembly 18. The low pressure oil reserve may be maintained within the inner body 144 by the sleeve 180 such that oil flows into the low pressure chamber 176, but cannot back feed through the inlet port 192 when oil pressure is lost, due to its location at the top of the low pressure chamber 176. Accordingly, the sleeve 180 functions as a seal for the low pressure chamber 176, while the air bleed hole 186 allows any air bubbles to bleed or purge from the low pressure chamber 176.

The check ball assembly 164 allows oil to travel form the low pressure chamber 176 into the high pressure chamber 174 when the HLA assembly expands 18 (i.e., by suppling oil through oil port 190. Once the HLA assembly 18 is loaded (i.e., the high pressure chamber 174 is filled) the check ball assembly 164 closes off the oil communication. This causes the high pressure chamber 174 to become sealed and able to provide adequate load support for the rocker arm 14 to rotate about.

The plunger 142 is disposed within the outer body 140 but surrounds the inner body 144. The plunger 142 interacts with the inner body 144 through a biasing mechanism 194 (e.g., a spring), which is configured to expand to absorb any lash in the system. Since outer body 140 is fixed with the cartridge 16, plunger 142 is biased downward by the biasing mechanism 194 to take up lash in the system. As such, the plunger 142 is the moving element of the HLA assembly 18 and provides a seat for the biasing mechanism 194.

Moreover, a controlled gap 196 is defined between the plunger 142 and the inner body 144 that allows oil to move from the bottom of the high pressure chamber 174 to the upper portion, which is connected to the leakdown surface 168. In the example implementation, the controlled gap 196 is controlled (e.g., minimized) to reduce the volume of oil in the high pressure chamber 174, thereby increasing the stiffness of the HLA assembly 18.

As illustrated, the deactivating HLA assembly 18 allows for a large reserve ratio (e.g., approximately 1.4:1) of fluid in the low pressure chamber 176 to the volume in the high pressure chamber 174 when the oil feed port 190 cannot be located near the top of the chamber 176. The reserve ratio is maximized by submerging part of the inner body 144 containing the low pressure chamber 176 into the high pressure chamber volume 174. As such, the HLA assembly 18 allows the oil to be supplied from a height below the top of the low pressure chamber 176, but prevents oil from draining out of the low pressure chamber 176 at engine shut down conditions, thereby leaving a full reservoir for when the engine starts up as it take a short time after engine start up for oil pressure to build and reach the HLA assembly 18. In this way, the sleeve 180 allows oil to reach the low pressure chamber 176 without having to flow though the lost motion biasing mechanism 132. As described, the oil can flow from oil feed port 190, upward through the oil channel 182 between the sleeve 180 and the inner body 144, and then into the low pressure chamber 176 through the inlet port 192.

With continued reference to FIG. 8, in the exemplary implementation, the deactivating HLA assembly 18 is movable between the activated and deactivated positions through the latch assemblies 200. FIG. 8 illustrates the leftmost latch assembly 200 in the activated position, while the rightmost latch assembly 200 is in the deactivated position, which allows HLA assembly 18 to absorb lost motion of rocker arm assembly 14. It should be noted however that in operation, both latch assemblies 200 will be either in the activated or deactivated positions.

In the illustrated example, each latch assembly 200 generally includes latch pin 202, a biasing mechanism 210, and a biasing mechanism retention feature 212. Each latch pin 202 includes a main body 214, and a stem 216 and a protrusion 218 extending from opposite sides of the main body 214. The biasing mechanism 210 (e.g., a spring) is disposed about the stem 216 between a shoulder 220 of main body 214 and the retention feature 212, which is disposed within aperture 128. The biasing mechanism 210 is configured to bias the latch pin 202 into the activated position towards and into engagement with outer body 140.

In the activated position (left latch, FIG. 8), the latch pin protrusion 218 extends into a groove 222 formed within the outer body 140 such that protrusion 218 engages groove shoulders 224 and prevents upward movement of the outer body 140. In the deactivated position (right latch, FIG. 8), a hydraulic fluid (e.g., oil) is supplied to groove 222 and overcomes the bias of biasing mechanism 210, thereby moving the latch pin 202 away from the outer body 140 such that the protrusion 218 no longer extends into groove 222. This enables upward movement of the outer body 140 such that lost motion biasing mechanism 132 can absorb motion from the rocker arm assembly 14 imparted by the cam lobe 60.

The deactivating HLA assembly 18 described herein provides advantages over conventional HLA assemblies. In the example implementation, HLA assembly 18 maximizes the diameter of inner body 144 by eliminating internal mass of the plunger 142 and utilizing the traditional ball body/spigot as the leakdown plunger. The check ball assembly 164 is locating between the inner body 144 and the plunger 142, which reduces the total volume within the plunger 142. As such, the stiffness of the HLA assembly 18 is improved by the diameter difference between the plunger 142 and the inner body 144, since HLA stiffness is directly dependent on the stiffness of the oil column in the HLA via the bulk modulus of the oil and the pressure acting on the oil column. In this way, the combined HLA diameter and reduced oil volume in the high pressure chamber significantly increases stiffness of the HLA assembly 18, which improves overall performance of the valve train assembly 10. Moreover, the low pressure chamber 176 is located partly inside the high pressure chamber 174, which maximizes the amount of oil contained in the low pressure chamber (maximizing the oil reserve ratio), while maintaining packaging space in the vertical direction. In addition, locating the inner body 144 within the plunger 142 reduces the volume of oil contained in the high pressure chamber and reduces the mass of the plunger 142.

Described herein are systems and methods for improving valve train assembly stiffness and performance. The valve train assembly includes a valve train carrier configured to receive a modular cartridge. The cartridge houses a deactivating HLA assembly with a unique high pressure and low pressure chamber configuration that increases the oil reserve ratio, reduces mass, and improves stiffness. The carrier can receive a dual latch assembly which further increases system stiffness. The carrier geometry is also configured to distribute valve train loads to further increase system stiffness. The valve train assembly further includes a rocker arm having a valve tip with a rotatable e-foot to maintain a proper connection with the engine valve and improving stiffness. Accordingly, the improved overall system stiffness provides improved valvetrain dynamics, valve lift, valve closing, and increased consistency.

The foregoing description of the examples has been provided for purposes of illustration and description. It is not intended to be exhaustive or to limit the disclosure. Individual elements or features of a particular example are generally not limited to that particular example, but, where applicable, are interchangeable and can be used in a selected example, even if not specifically shown or described. The same may also be varied in many ways. Such variations are not to be regarded as a departure from the disclosure, and all such modifications are intended to be included within the scope of the disclosure.

What is claimed is:

1. A valve train carrier for a valve train assembly, the valve train carrier comprising:

a body having a top surface and a bottom surface;

a left bank configured to operably connect to at least one exhaust rocker arm assembly associated with an exhaust valve, wherein the left bank is configured to operably connect to four exhaust rocker arm assemblies, and wherein the left bank is configured to operably connect to two standard position exhaust rocker arm assemblies and two cylinder deactivation (CDA) position exhaust rocker arm assemblies;

a right bank configured to operably connect to at least one intake rocker arm assembly associated with an intake valve, wherein the right bank is configured to operably connect to four intake rocker arm assemblies, and wherein the right bank is configured to operably connect to two standard position intake rocker arm assemblies and two CDA position intake rocker arm assemblies; and a cartridge cavity configured to receive a modular cartridge that houses a hydraulic lash adjustment (HLA) assembly.

2. The valve train carrier of claim 1, wherein the cartridge cavity is formed in the body bottom surface such that the modular cartridge is inserted into the cavity from below the body.

3. The valve train carrier of claim 1, further comprising two oil control valve apertures formed in the body configured to each receive an oil control valve.

4. A rocker arm assembly for a valve train assembly, the rocker arm assembly comprising:

a body configured to engage a hydraulic lash adjustment (HLA) assembly;

a first end having a roller;

a second end having a socket formed therein, the socket including a hemispherical contact surface; and an e-foot extending through the socket and coupled to the second end, the e-foot configured to maintain substantially flat contact with a top surface of an engine valve;

wherein the e-foot includes a hemispherical body and a post extending therefrom, the hemispherical body configured to ride the hemispherical contact surface;

wherein the post extends through a slot the socket, the slot configured to guide and restrain movement of the e-foot; and wherein the post is coupled to the body by at least one of staking and a clip.

5. The rocker arm assembly of claim 4, wherein the body includes a pair of lateral flanges connected by a connecting plate, the socket being formed in the connecting plate;

a recess formed in the connecting plate configured to mate with a spigot of the HLA assembly, the recess and spigot forming a fulcrum about which the rocker arm assembly can rotate;

wherein the body further includes a bridge coupled between the lateral flanges opposite the connecting plate.

6. The rocker arm assembly of claim 5, wherein the lateral flanges each include an aperture to receive an axle of the roller.

7. A cartridge for a valve train carrier of a valve train assembly, the cartridge comprising:

a main body defining an inner bore configured to receive and house a hydraulic lash adjustment (HLA) assembly; and a first latch flange extending outwardly from the main body, the first latch flange defining a first latch bore having a first latch assembly configured to selectively engage the HLA assembly, wherein the cartridge is sized and shaped for removable insertion into a cartridge cavity formed in an underside of the valve train carrier, the cartridge configured to have a valve train lash set prior to insertion into the cartridge cavity.

8. The cartridge of claim 7, wherein the cartridge is fabricated from iron or steel.

9. The cartridge of claim 8, wherein the cartridge is fabricated from cast iron and graphite.

10. The cartridge of claim 7, further comprising an upper flange extending upwardly from the main body, the upper flange partially defining the inner bore.

11. The cartridge of claim 10, further comprising a lower flange extending downwardly from the main body, the lower flange partially defining the inner bore.

12. The cartridge of claim 7, further comprising a fluid port configured to receive a hydraulic fluid from the valve train carrier and supply the hydraulic fluid to the HLA assembly.

13. The cartridge of claim 7, further comprising a second latch flange extending outwardly from the main body, the second latch flange defining a second latch bore having a second latch assembly configured to selectively engage the HLA assembly;

wherein the first latch assembly is disposed opposite the second latch assembly; and wherein the first and second latch flanges define an upper surface configured to contact the valve train carrier and distribute loads in the valve train assembly.

14. The cartridge of claim 7, wherein the first latch assembly is selectively movable between a first position and a second position by selectively supplying a hydraulic fluid to the first latch assembly.

15. The cartridge of claim 7, wherein the first latch assembly is selectively movable between a first position and a second position by a solenoid.

16. The cartridge of claim 13, wherein the first latch assembly includes a first latch pin and a first pin biasing mechanism configured to bias the first latch pin into engagement with the HLA assembly to prevent relative movement between the cartridge and the HLA assembly; and wherein the second latch assembly includes a second latch pin and a second latch pin biasing mechanism configured to bias the second latch pin into engagement with the HLA assembly to further prevent relative movement between the cartridge and the HLA assembly.

17. The cartridge of claim 7, wherein the latch flange further includes a latch pin orientation feature configured to maintain alignment of a latch pin shelf when the latch assembly is in a retracted position.

18. The cartridge of claim 15, wherein the solenoid is an electro-mechanical device.

19. The cartridge of claim 18, wherein the solenoid is configured to directly couple to the valve train carrier.

20. The cartridge of claim 15, wherein the solenoid is directly coupled to the valve train carrier.

21. The cartridge of claim 17, wherein the first latch assembly includes a first latch pin extending through an aperture formed in the latch pin orientation feature.

22. The cartridge of claim 21, wherein the first latch pin includes a flat surface, and the aperture includes a flat portion, the flat surface and the flat portion facilitating preventing rotation of the first latch pin within the aperture.

23. The cartridge of claim 22, wherein the latch pin orientation feature is coupled to the latch flange in a desired angular orientation to subsequently dispose a shelf of the latch pin in a desired orientation to selectively engage a groove shoulder of the HLA assembly.

24. The cartridge of claim 15, wherein the latch pin orientation feature defines a notch.

25. The cartridge of claim 24, further comprising a retention bolt inserted through the notch and into the latch flange to couple the latch pin orientation feature to the latch flange.

26. The cartridge of claim 15, wherein the latch pin orientation feature is welded to the latch flange.

27. The cartridge of claim 15, wherein the latch pin orientation feature is disposed within a recess formed in an outer surface of the latch flange.

28. The cartridge of claim 27, wherein the latch pin orientation feature is flush with the latch flange outer surface when the latch pin orientation feature is disposed within the recess.

29. A rocker arm assembly for a valve train assembly, the rocker arm assembly comprising:

a body configured to engage a hydraulic lash adjustment (HLA) assembly, wherein the body includes a pair of lateral flanges connected by a connecting plate;

a first end having a roller;

a second end having a socket formed therein, the socket being formed in the connecting plate;

an e-foot extending through the socket and coupled to the second end, the e-foot configured to maintain substantially flat contact with a top surface of an engine valve; and a recess formed in the connecting plate configured to mate with a spigot of the HLA assembly, the recess and spigot forming a fulcrum about which the rocker arm assembly can rotate;

wherein the body further includes a bridge coupled between the lateral flanges opposite the connecting plate.

30. The rocker arm assembly of claim 29, wherein the lateral flanges each include an aperture to receive an axle of the roller.

* * * * *